US007258655B2

(12) United States Patent
Saro et al.

(10) Patent No.: US 7,258,655 B2
(45) Date of Patent: Aug. 21, 2007

(54) GATHERING AND PRESSING DEVICE FOR A FOLDED BOX-GLUING MACHINE

(75) Inventors: Karl Saro, Ratingen (DE); Wolfgang Diehr, Grevenbroich (DE); Klaus Naber, Kempen (DE); Klaus Torka, Mönchengladbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 79 days.

(21) Appl. No.: 11/122,878

(22) Filed: May 4, 2005

(65) Prior Publication Data

US 2005/0250634 A1 Nov. 10, 2005

(30) Foreign Application Priority Data

May 4, 2004 (DE) ..... 10 2004 022 209

(51) Int. Cl.
*B31B 3/00* (2006.01)
*B31B 1/00* (2006.01)
*B31B 1/02* (2006.01)

(52) U.S. Cl. ..... 493/71; 493/142; 493/183

(58) Field of Classification Search ..... 493/67, 493/68, 69, 70, 71, 72, 141, 142, 144, 183; 198/781.06, 788, 789
See application file for complete search history.

(56) References Cited

U.S. PATENT DOCUMENTS 3,045,586 A * 7/1962 Blood ..... 100/154
3,054,514 A * 9/1962 Riley ..... 414/746.2
3,292,504 A 12/1966 Gres
3,605,585 A * 9/1971 Mitchell ..... 493/282
4,102,252 A * 7/1978 Reichert ..... 493/132
4,519,181 A * 5/1985 Sherman et al. ..... 53/377.4
4,551,708 A * 11/1985 Welburn ..... 341/116
4,585,432 A * 4/1986 Marysse ..... 493/59
4,683,704 A * 8/1987 Vorachek et al. ..... 53/461
4,988,330 A * 1/1991 Bensberg ..... 493/16
5,997,459 A * 12/1999 Kruger et al. ..... 493/441
6,503,181 B1 1/2003 Pons

FOREIGN PATENT DOCUMENTS

DE 198 28 820 A1 12/1999
DE 198 28 821 A1 12/1999
WO 96/09970 4/1996

* cited by examiner

*Primary Examiner*—Louis K. Huynh
*Assistant Examiner*—Paul Durand
(74) *Attorney, Agent, or Firm*—Laurence A. Greenberg; Werner H. Stemer; Ralph E Locher

(57) ABSTRACT

A gathering and pressing device for a folded box gluing machine has two machine-width, circulating conveyor belts which are connected to a drive and whose conveying runs are disposed horizontally, one above the other and running parallel to each another. An upper conveying run of the lower conveyor belt being mounted such it can be moved vertically with respect to the lower conveying run of the upper conveyor belt in order to press the folded blanks. Both the lower conveyor belt and the upper conveyor belt having their own drive which includes a servomotor with a resolver connected directly to the respective drive roll.

5 Claims, 4 Drawing Sheets

GATHERING AND PRESSING DEVICE FOR A FOLDED BOX-GLUING MACHINE

BACKGROUND OF THE INVENTION

Field of the Invention

The invention relates to a gathering and pressing device for a folded box gluing machine. The device has two machine-width, circulating conveyor belts, which are connected to a drive and whose conveying runs are disposed horizontally, one above the other and running parallel to each another. The upper conveying run of the lower conveyor belt is mounted such that it can be moved vertically with respect to the lower conveying run of the upper conveyor belt in order to press the folded blanks.

As is known, a folded box gluing machine for producing folding boxes from blanks have at least the now described processing stations. A feeder, which pulls the blanks to be processed from a stack one after another at high speed and feeds them individually to the following processing station. A folding station, in which the blank parts provided with a strip of glue are folded in order to produce a glued joint. A transfer station, from which the folded blanks, aligned exactly, are supplied to the following gathering and pressing device, and a gathering and pressing device, in which an overlapping stream of folded blanks is formed, which is subsequently conveyed onward and kept under pressure between conveyor belts configured as pressing belts, in order that the glued seams bond.

The known gathering and pressing devices have a common drive for the upper and lower conveyor belts, of which in each case a drive roll around which the respective conveyor belt runs is driven by a chain. The lower conveying run of the upper conveyor belt and the upper conveying run of the lower conveyor belt are in each case supported by supporting rollers on their rear side, in order that the folded blanks are conveyed and kept under pressure between the two runs. The supporting rollers of the lower conveyor belt are mounted such that they can be moved downward counter to a spring force, in order that streams of boxes of different thicknesses can be conveyed through with an adjustable pressing pressure.

In the case of the known gathering and pressing devices, it has been shown that, depending on the type of box to be produced, the processing speed is limited and/or the quality of the boxes produced is impaired.

SUMMARY OF THE INVENTION

It is accordingly an object of the invention to provide a gathering and pressing device for a folded box-gluing machine which overcomes the above-mentioned disadvantages of the prior art devices of this general type, by which even complicated box types can be produced at an increased production speed and with high quality.

With the foregoing and other objects in view there is provided, in accordance with the invention, a gathering and pressing device for a folded box gluing machine. The gathering and pressing device contains drive rollers, drives each having a servomotor with resolver and connected directly to a respective one of the drive rollers, and two machine-width, circulating conveyor belts driven by the drives and having conveying runs disposed horizontally, one above another and running parallel to each other. The conveyor belts include an upper conveyor belt having a lower conveying run and a lower conveyor belt having an upper conveying run mounted for moving vertically with respect to the lower conveying run of the upper conveyor belt for pressing folded blanks. Each of the lower conveyor belt and the upper conveyor belt are driven by a separate one the drives.

The object is achieved, in that both the lower and the upper conveyor belt have their own drive, and the drive has a servomotor with a resolver connected directly to the respective drive roll.

This solution with highly dynamic drives permits a higher production speed with a high product quality, since the drives can be braked and accelerated more quickly and, in addition, can be operated with a speed difference. Very short braking times and acceleration times are necessary if individual blanks have previously been removed from the machine by ejection systems, for example because they are faulty. In order to close the gaps produced when a blank is ejected, to produce a constant overlapping stream, which the following automatic packing machine requires, the conveyor belts have to be braked briefly and then accelerated again. In the case of the known drive, this leads to considerable loadings on the mechanical elements, so that the production speed is limited.

As a result of the lack of the connecting chain, during the braking and acceleration the pressurized displacement of the upper conveyor belt toward the lower conveyor belt is dispensed with and, in addition, the wear is reduced considerably. This makes it possible to increase the maximum speed of the conveyor belts by about 50% to about 60 m/min. Furthermore, it has been shown that, in the case of the known conveyor belts with a rigidly coupled drive, impairment of the quality in the finished products can occur. The lower, compliantly mounted conveyor belt gives way downward under the applied pressure. As a result of giving way, the lower conveyor belt has to some extent to cover a longer distance than the upper conveyor belt. Since, on account of the rigid coupling, the conveying speeds are the same, a stress is built up which leads to box parts delivered lying exactly one above another being displaced with respect to each other. According to the invention, the drives of the two conveyor belts can preferably be regulated relative to each other via a common control device. It is thus possible for a speed difference to be set between the upper conveyor belt and the lower conveyor belt, in order to avoid mutual displacement of box parts.

According to a further solution, the conveying run of the lower conveyor belt is supported by a row of supporting rollers running transversely, which are mounted in such a way that their ends on the one side can be moved upward by pressure independently of the ends on the other side.

This makes it possible to act uniformly with pressure on the types of blank which have a different number of layers in the glued region and are configured asymmetrically. In the case of asymmetrical blanks, which are not uniformly thick over the width of the conveyor belts, the supporting rollers can be set somewhat obliquely. This prevents the pressure being applied only at the thickened points of the blanks.

According to a further solution, the lower conveyor belt begins on the inlet side before the upper conveyor belt, and above the exposed region of the lower conveyor belt there are disposed at least two short belt conveyors which, in each case together with the lower conveyor belt, form an incoming inlet gap for the blanks, it being possible for the part of each belt conveyor on the inlet side to be pivoted upward and downward in order to change the inlet gap. Each belt conveyor has its own pivoting drive, which permits motorized adjustment from outside.

The ability of each inlet gap to be adjusted individually makes it possible to brake the blanks, arriving with high momentum, without rotation. For this purpose, each inlet gap can be set as a function of the type of blank. Since, when the machine speed is changed, the momentum force likewise changes, the inlet gaps have to be corrected during the running production process, in order that the blanks are braked without rotation. The motorized adjustment from outside is more convenient for the operator and the risk of accidents is reduced drastically, since it is no longer necessary to reach into a running machine.

Other features which are considered as characteristic for the invention are set forth in the appended claims.

Although the invention is illustrated and described herein as embodied in a gathering and pressing device for a folded box-gluing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
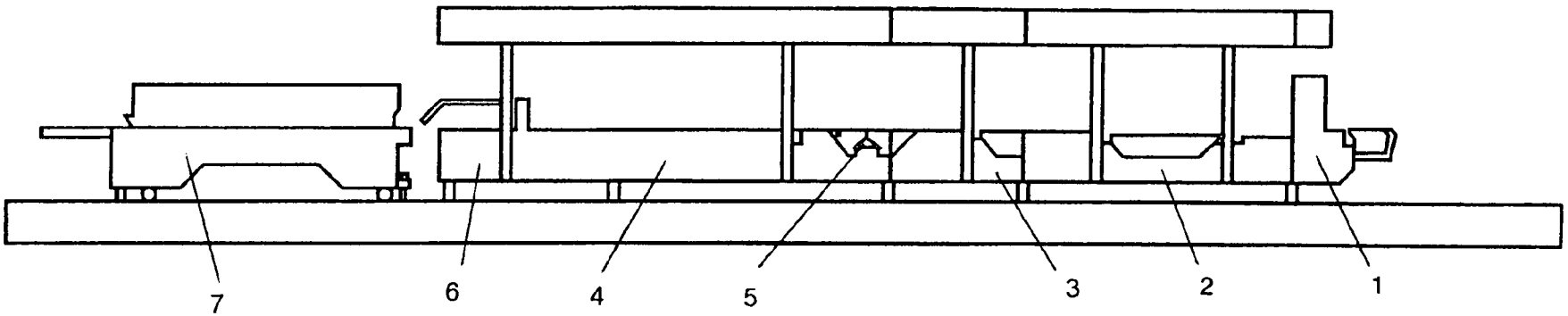
FIG. 1 is a diagrammatic, side-elevational view of individual stations of a folded box-gluing machine according to the invention.

Referring now to the figures of the drawing in detail and first, particularly, to FIG. 1 thereof, there is shown in a conveying direction (from right to left), a folded box machine beginning with a feeder 1, which pulls the blanks to be processed out of a stack one after another at high speed and feeds them individually to the following processing station. The feeder 1 is followed, as next processing stations, by two pre-creasers 2, 3, which contain folding elements in order to fold folding flaps forward and back. As a result of being bent through 180°, the corresponding left-hand grooved lines of the blanks are made soft and supple.

The pre-creaser 3 is followed, as the next processing station, by the folding station 4, at the start of which an applicator 5 for adhesive, normally glue, is disposed. The adhesive applicator 5 contains glue nozzles or glue disks, by which the adhesive is applied to the blanks in the form of strips. The folding flaps of the blanks are then folded by folding elements.

As the next station there follows a transfer station 6, in which the folded blanks, not yet provided with the bonded glued seams, are supplied with all the parts aligned exactly to a following gathering and pressing device 7. In the region of the transfer station 6, it is possible to dispose devices with which the boxes are counted, marked and, if damaged, removed. In the gathering and pressing device 7, an overlapping stream of folded blanks is formed, which is subsequently kept under pressure for some time between pressing belts in order that the glued seams bond. Finally, there is often disposed a packing device, in which the folded boxes, lying flat, are packed into cartons.

The gathering and pressing device 7 illustrated in more detail as an extract in FIGS. 2 to 5 has two machine-width, circulating conveyor belts 8, 9, of which the inner conveying runs are disposed horizontally, running one above the other and at a short distance from and parallel to each another. Each of the conveyor belts 8, 9 runs around a drive roller 10, 11, which is in each case connected directly to a drive 12, 13. Each of the drives 12, 13 contains a controlled-speed servomotor with resolver; use is preferably made of three-phase servomotors with resolver feedback, in which the rotational angle is registered and used to regulate the motor. The motors can be controlled very accurately and can be accelerated and braked very quickly. In addition, they have relatively high torques at relatively low speeds.

The two drives 12, 13 can be controlled separately by a central control device, so that a speed difference can be set. They are fixed to lateral frame walls 14 of the device. Associated switch boxes are preferably in each case disposed on the outside beside the drives 12, 13 and in this way cover the lateral outer end of the latter. The switch boxes thus serve as a guard at the same time and prevent injury to the operators.

Both the conveying runs of the conveyor belts 8, 9 are in each case supported on their rear side by a row of supporting rollers 15, 16 running transversely. While the supporting rollers 16 of the upper conveyor belt 9 are mounted in a fixed position in the frame 14 such that they can rotate freely, the mounting of the supporting rollers 15 of the lower conveyor belt 8 permits a limited movement upward and downward. For this purpose, the ends of the supporting rollers 15 on each side of the frame are mounted such that they can rotate freely in a bearing plate 17, which is fixed to a piston of a piston-cylinder unit 18. The cylinder of the piston-cylinder unit 18 is fixed to the frame wall 14. By this mounting on both sides of the apparatus, the ends of the supporting rollers 15 can be forced upward on one side by the piston-cylinder unit 18 independently of the ends of the other side. According to the preferred exemplary embodiment, in each case four supporting rollers 15 are fixed jointly to a bearing plate 17 on each side and, in this way, are forced upward together. The bearing plates 17 are fixed to the piston at their center such that they can tilt about an axis, the tilt axis running parallel to the axis of rotation of the supporting roller 15. Each jointly mounted group of supporting rollers 15 can thus also adapt in terms of its inlet angle with respect to the conveying plane when pressing on an incoming stream of blanks.

The pneumatic piston-cylinder units 18 contain precise pressure regulators, which permit very precise setting of the upwardly directed pressure of the supporting rollers 15. The piston-cylinder units 18 on each side can be controlled independently of each another, so that different pressures can be set on the two sides. This makes it possible to set the supporting rollers 15 in a freely selectable oblique position with respect to the stream of blanks, in order to exert the most uniform pressure possible even on asymmetrical blanks, which are not uniformly thick over the width of the conveyor belts 8, 9.

Figure 2:
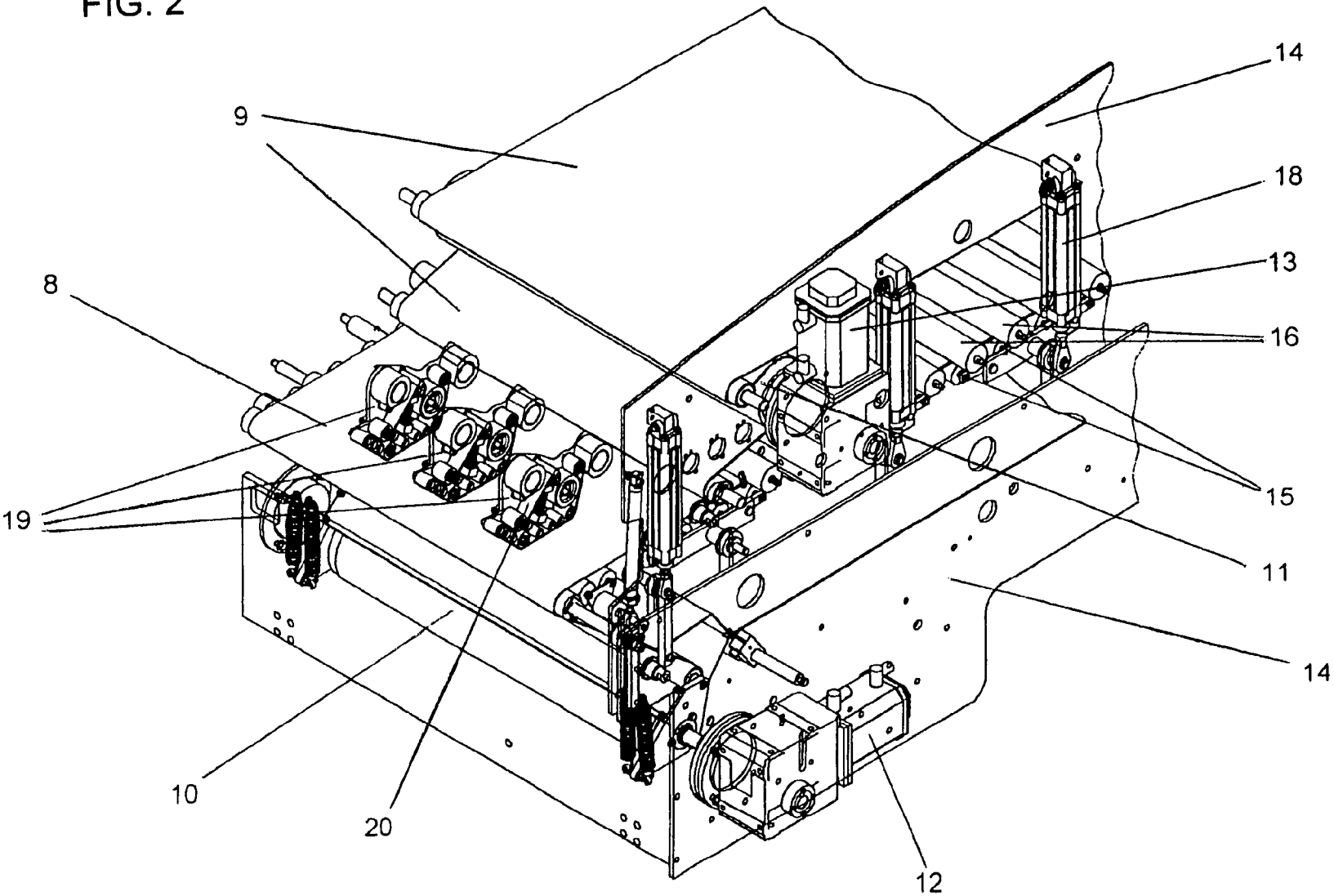
FIG. 2 is a diagrammatic, perspective view of part of a gathering and pressing device.
Figure 3:
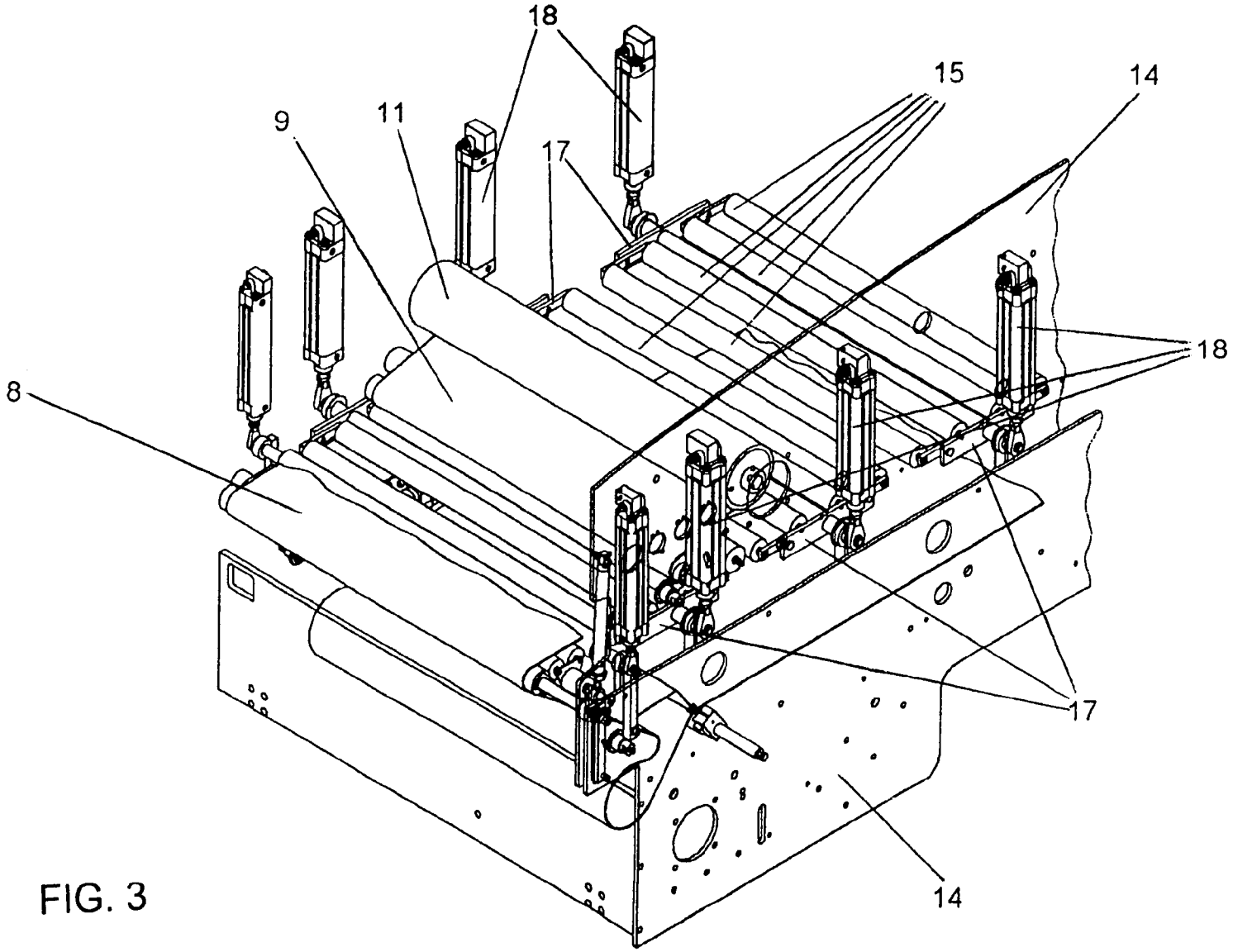
FIG. 3 is a diagrammatic, perspective view showing the mounting of supporting rollers of a lower conveyor belt.

As FIG. 2 reveals, the lower conveyor belt 8 begins before the upper conveyor belt 9 on the inlet side. Above the exposed region of the lower conveyor belt 8 there are disposed at least two, preferably three, short belt conveyors 19 which, in each case with the lower conveyor belt 8, form a tapering inlet gap for the blanks. The short belt conveyors 19 are used to produce an exactly aligned stream of blanks, which is then guided between the pressing conveyor belts 8, 9.

The three belt conveyors 19 are disposed beside one another at a distance and can be positioned transversely individually by an adjustment drive 21, 22. Belts 20 of the belt conveyors 19 are driven jointly by a drive shaft running transversely, which is connected to the drive 13 by a non-illustrated belt drive.

Figure 5:
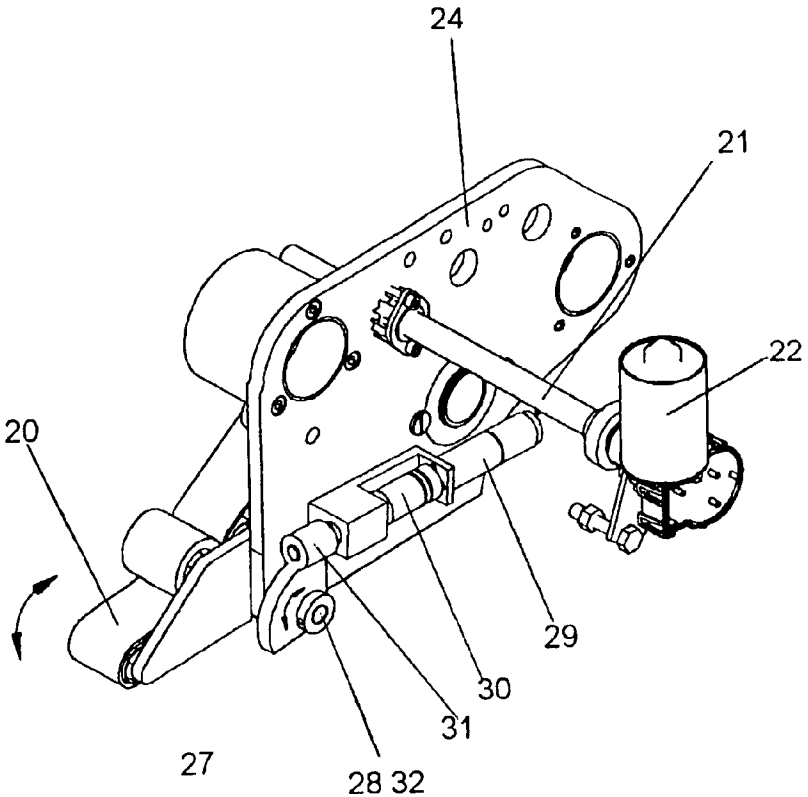
FIGS. 4 and 5 are diagrammatic, perspective views showing one of the belt conveyors, which are disposed on an inlet side.
Figure 4:
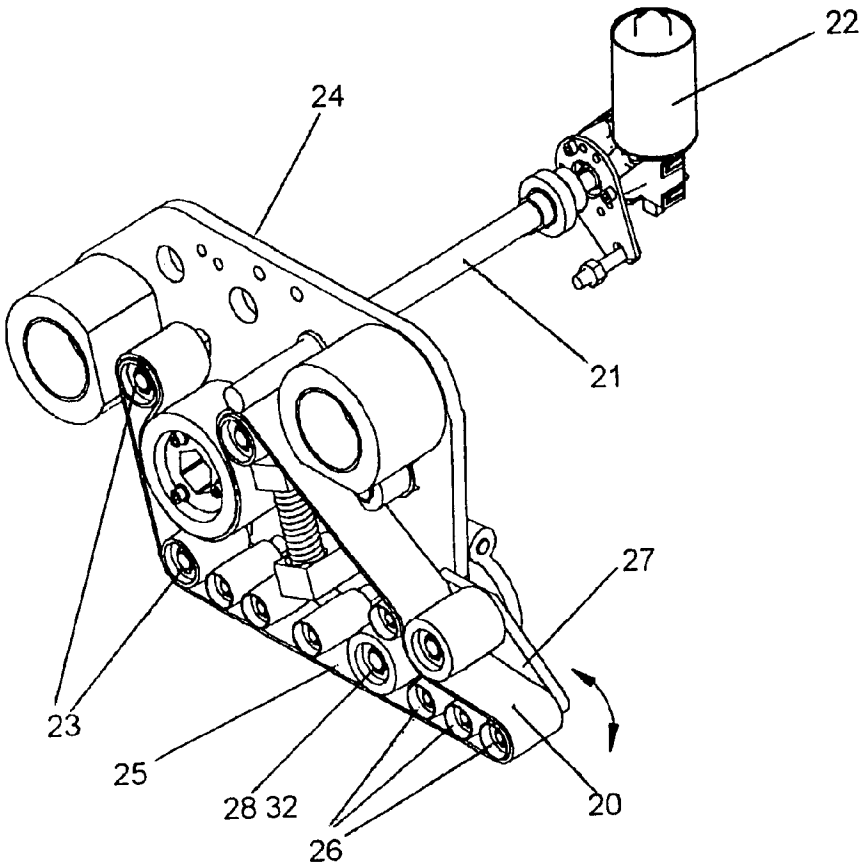

The construction of the belt conveyor 19 is illustrated in more detail in FIGS. 4 and 5:

Each belt conveyor 19 contains a circulating belt 20, which is led over deflection rollers 23 which are mounted in a bearing plate 24 that can be displaced transversely. A lower conveying run 25 runs horizontally in its rear part (on the left in FIG. 4) and thus parallel with the lower conveyor belt 8. Three deflection rollers 26 on the inlet side are mounted on an additional plate 27, which is fixed to the bearing plate 24 such that it can be pivoted about an axis 28. The part of each belt conveyor on the inlet side can in this way be pivoted upward and downward in order to change the inlet gap. Each belt conveyor 19 has its own pivoting drive, which permits motorized adjustment of the inlet gap from outside. As FIG. 5 illustrates, a geared motor 29, which drives a worm gear 31 via a slipping clutch 30, is fixed to the rear side of the bearing plate 24. The worm gear 31 drives a pivoting shaft 32, which leads through the bearing plate 24 and which, at its other end, is connected to the additional plate 27. Thus, for each belt conveyor 19, the inlet gap can be set separately from outside and corrected during operation if the machine speed changes. It is no longer necessary for an operator to reach into the running apparatus in order to correct the inlet gap.

This application claims the priority, under 35 U.S.C. § 119, of German patent application No. 10 2004 022 209.6, filed May 4, 2004; the entire disclosure of the prior application is herewith incorporated by reference.

We claim:

1. A gathering and pressing device for a folded box gluing machine, the gathering and pressing device comprising:

drive rollers;

drives each having a servomotor with resolver and connected directly to a respective one of said drive rollers, said drives being controlled-speed three-phase servomotors with resolver feedback;

two machine-width, circulating conveyor belts being driven by said drives and having conveying runs disposed horizontally, one above another and running parallel to each other, said conveyor belts including an upper conveyor belt having a lower conveying run and a lower conveyor belt having an upper conveying run mounted for moving vertically with respect to said lower conveying run of said upper conveyor belt for pressing folded blanks, each of said lower conveyor belt and said upper conveyor belt being driven by a separate one of said drives; and a common control device for regulating said drives of said conveyor belts.

2. A gathering and pressing device for a folded box gluing machine, the gathering and pressing device comprising;

a drive;

a row of supporting rollers, said supporting rollers, each having a respective end on a first side of said rollers and another respective end on a second side of said rollers having ends and said supporting rollers running transversely, said row of supporting rollers mounted for moving said ends on a first side upward by pressure independently of said ends on a second side; and two machine-width, circulating conveyor belts connected to said drive and having conveying runs disposed horizontally, one above another and running parallel to each other, said conveyor belts including an upper conveyor belt having a lower conveying run and a lower conveyor belt having an upper conveying run mounted for moving vertically with respect to said lower conveying run of said upper conveyor belt for pressing folded blanks, said conveying run of said lower conveyor belt supported by said row of supporting rollers;

bearing plates;

a frame;

piston-cylinder units fixed to said frame and each having a respective piston; and said ends of at least one of said supporting rollers on each of said first and second sides being mounted to a respective one of said bearing plates, each of said bearing plates fixed to said piston of a respective one of said piston-cylinder units, said bearing plates fixed to said piston-cylinder units for pivoting said bearing plates about an axis parallel to an axis of rotation of said supporting rollers.

3. A gathering and pressing device for a folded box gluing machine, the gathering and pressing device comprising:

belt conveyors each having a pivoting drive;

a drive; and two machine-width, circulating conveyor belts connected to said drive and having conveying runs disposed horizontally, one above another and running parallel to each other, said conveyor belts including an upper conveyor belt having a lower conveying run and a lower conveyor belt having an upper conveying run mounted for moving vertically with respect to said lower conveying run of said upper conveyor belt for pressing folded blanks, said lower conveyor belt beginning before said upper conveyor belt on an inlet side and, at least two of said belt conveyors being disposed above an exposed region of said lower conveyor belt, at least two of said belt conveyors each forming a tapering inlet gap with said lower conveyor belt, for the folded blanks, a part of each said belt conveyors on said inlet side being pivotable upward and downward by said pivoting drive for changing said tapering inlet gap.

4. The device according to claim 3, wherein:

each of said belt conveyors has a pivotable plate disposed on said inlet side, deflection rollers mounted on said pivotable plate on said inlet side, and a conveyor belt guided by said deflection rollers; and said pivoting drive includes a geared motor, a slipping clutch and a worm gear drive acting on said pivotable plate.

5. The device according to claim 3, wherein there are three of said belt conveyors.

* * * * *